US008636072B2

(12) United States Patent
Gette et al.

(10) Patent No.: US 8,636,072 B2
(45) Date of Patent: Jan. 28, 2014

(54) WELLHEAD ASSEMBLY HAVING SEAL ASSEMBLY WITH AXIAL RESTRAINT

(75) Inventors: Nicholas P. Gette, Houston, TX (US); Daniel W. Fish, Magnolia, TX (US)

(73) Assignee: Vetco Gray Inc., Houston, TX (US)

( * ) Notice: Subject to any disclaimer, the term of this patent is extended or adjusted under 35 U.S.C. 154(b) by 988 days.

(21) Appl. No.: 12/190,431

(22) Filed: Aug. 12, 2008

(65) Prior Publication Data

US 2010/0038089 A1 Feb. 18, 2010

(51) Int. Cl.
*E21B 33/035* (2006.01)

(52) U.S. Cl.
USPC ..... 166/341; 166/348; 166/368; 166/387; 166/85.3; 277/322

(58) Field of Classification Search
USPC ..... 166/345, 339, 341, 348, 368, 378, 381, 166/382, 387; 277/322, 336–340
See application file for complete search history.

(56) References Cited

U.S. PATENT DOCUMENTS

| | | | | | |
|---|---|---|---|---|---|
| 3,404,736 | A | * | 10/1968 | Nelson et al. | 166/89.1 |
| 4,131,287 | A | * | 12/1978 | Gunderson et al. | 277/328 |
| 4,665,979 | A | * | 5/1987 | Boehm, Jr. | 166/208 |
| 4,674,576 | A | * | 6/1987 | Goris et al. | 166/382 |
| 4,714,111 | A | * | 12/1987 | Brammer | 166/182 |
| 4,719,971 | A | * | 1/1988 | Owens | 166/191 |
| 4,742,874 | A | * | 5/1988 | Gullion | 166/348 |
| 4,751,965 | A | * | 6/1988 | Cassity | 166/182 |
| 4,766,956 | A | * | 8/1988 | Smith et al. | 166/182 |
| 4,790,572 | A | * | 12/1988 | Slyker | 285/123.12 |
| 4,823,871 | A | * | 4/1989 | McEver et al. | 166/182 |
| 4,842,061 | A | * | 6/1989 | Nobileau | 166/115 |
| 4,932,472 | A | * | 6/1990 | Boehm, Jr. | 166/208 |
| 4,949,786 | A | * | 8/1990 | Eckert et al. | 166/208 |
| 4,949,787 | A | * | 8/1990 | Brammer et al. | 166/208 |
| 4,960,172 | A | * | 10/1990 | Nelson | 166/208 |
| 5,020,593 | A | | 6/1991 | Milberger | |
| 5,038,865 | A | * | 8/1991 | Taylor et al. | 166/387 |
| 5,060,724 | A | * | 10/1991 | Brammer et al. | 166/208 |
| 5,174,376 | A | * | 12/1992 | Singeetham | 166/208 |
| 5,249,629 | A | * | 10/1993 | Jennings | 166/348 |
| 5,285,853 | A | * | 2/1994 | Eckert et al. | 166/382 |

(Continued)

FOREIGN PATENT DOCUMENTS

| | | | |
|---|---|---|---|
| GB | 2230035 | A | 10/1990 |
| GB | 2274477 | A | 7/1994 |
| WO | 2010002686 | A1 | 1/2010 |

OTHER PUBLICATIONS

U.S. Appl. No. 13/172,537, filed Jun. 29, 2011.

(Continued)

*Primary Examiner* — Matthew Buck
(74) *Attorney, Agent, or Firm* — Bracewell & Giuliani LLP

(57) ABSTRACT

A wellhead system comprising a seal with a restraining member adapted to cooperate with a housing to restrict axial movement of the seal. The seal is adapted to form a seal between the housing, such as a wellhead, and a tubular member, such as a casing hanger. The seal has a latch ring that is expanded outward as the seal is installed within the wellhead. Axial movement of the seal is restricted by engagement between the expanded latch ring and the inner profile of the housing. The seal and housing may be adapted so that a portion of the seal is received by a recess in the inner profile of the housing.

8 Claims, 14 Drawing Sheets

(56) References Cited

U.S. PATENT DOCUMENTS

| | | | | |
|---|---|---|---|---|
| 5,307,879 | A * | 5/1994 | Kent | 166/382 |
| 5,327,965 | A * | 7/1994 | Stephen et al. | 166/208 |
| 5,355,961 | A * | 10/1994 | Gariepy et al. | 166/387 |
| 5,360,063 | A * | 11/1994 | Henderson, Jr. | 166/208 |
| 5,372,201 | A * | 12/1994 | Milberger | 166/382 |
| 5,456,314 | A * | 10/1995 | Boehm et al. | 166/208 |
| 5,725,056 | A * | 3/1998 | Thomson | 166/382 |
| 5,735,344 | A * | 4/1998 | Duncan | 166/75.14 |
| 6,367,558 | B1 * | 4/2002 | Borak, Jr. | 166/387 |
| 6,510,895 | B1 * | 1/2003 | Koleilat et al. | 166/208 |
| 6,520,263 | B2 * | 2/2003 | June | 166/368 |
| 6,668,919 | B2 * | 12/2003 | Radi | 166/208 |
| 7,559,366 | B2 * | 7/2009 | Hunter et al. | 166/217 |
| 7,762,319 | B2 * | 7/2010 | Nelson | 166/84.1 |
| 2010/0007097 | A1 * | 1/2010 | Sundararajan | 277/595 |
| 2010/0147533 | A1 | 6/2010 | Nelson | |
| 2010/0193195 | A1 * | 8/2010 | Nguyen et al. | 166/338 |
| 2011/0005774 | A1 | 1/2011 | Sinnott et al. | |

OTHER PUBLICATIONS

GB Search Report dated Jun. 22, 2012 from corresponding Application No. GB0913332.3.

GB Office Action dated Dec. 23, 2011 from corresponding Application No. GB0913332.3.

GB Search Report dated Oct. 26, 2009 front corresponding Application No. GB0913332.3.

* cited by examiner

WELLHEAD ASSEMBLY HAVING SEAL ASSEMBLY WITH AXIAL RESTRAINT

BACKGROUND

The invention relates generally to seal assemblies for use in sealing components of oil and gas wells. In particular, the invention relates to a seal assembly for a casing hanger or a tubing hanger of a wellhead, the seal assembly having a system for axially restraining the seal assembly within the wellhead and a method for installing the seal assembly in the wellhead.

Casing is strong steel pipe that is used in an oil and gas well to ensure a pressure-tight connection from the surface to the oil and/or gas reservoir. Casing serves many purposes in the well. It can protect the wellbore from caving in or being washed out. It can also confine production to the wellbore, so that water does not intrude into the wellbore or drilling mud intrude into the surrounding formations. It can also provide an anchor for the components of the well. Production tubing, such as coiled tubing, typically is used to transport oil to the surface.

Several sections of casing joined together end-to-end are known as a "casing string." Because casing serves several different purposes, it is typical to install more than one casing string in a well. Casing strings typically are run in a concentric arrangement, similar to an upside-down wedding cake, which extends downward into the ground from a wellhead located at the surface. For example, the casing string with the greatest diameter is the shortest, followed by smaller diameter casing string which goes deeper than the first casing string, followed by an even smaller diameter casing string that is run even deeper than the second casing string.

A casing hanger is a device that is used to support a casing string from a wellhead or other structure within the well. In addition, the casing hanger serves to ensure that the casing is properly located in the well. When the casing string has been run into the wellbore, the casing string is hung, or suspended, in the well by the casing hanger. Typically, the casing hanger rests on a landing shoulder inside the wellhead. Multiple casing hangers may be supported within a single wellhead.

Seals are used to seal the annulus between the casing hanger and the wellhead to isolate fluids in different casing strings from each other and to prevent production fluid from being diverted from its desired path. However, forces in the well may be produced that urge the seals upward, potentially causing the seals to leak. This also may lead to the seal unseating and moving relative to the casing hanger or tubing hanger. For example, fluid pressure in the annulus may urge the seal upward or downward. Similarly, thermal conditions in the annulus may exert forces that urge the seal upward.

One method that has been attempted to restrain axial movement of the casing hanger seal and casing hanger is by installing a latch ring on the casing hanger. The latch ring extends between the casing hanger and wellhead. The latch ring is activated by the installation of the seal. Unfortunately, a latch ring that is installed on a casing hanger will restrict the flow of fluid in the annulus surrounding the casing hanger during cementing operations. The casing string is cemented in position within the wellbore of the well. Cement is poured down the interior of the casing string and flows out the bottom of the casing string into the annulus between the casing string and its nearest concentric drill string. Fluid in the annulus is displaced upward through the annulus. The casing hanger latch ring interferes with the flow of this fluid.

Another method that has been used to restrain axial movement of the casing hanger and casing hanger seal is the use of wickers. Wickers are located on the outer surface of the casing hanger and inner surface of the casing hanger seal. Similar wickers are located on the outer surface of the casing hanger seal and the inner surface of the wellhead. The seal material is softer than the wellhead and casing hanger materials. When the seal is activated, the softer material of the seal is driven into the wickers of the casing hanger and wellhead. The engagement between the various wickers limits axial movement of the casing hanger and casing hanger seal relative to the wellhead. However, there are physical limits to the pressures and thermal conditions that this wicker configuration can be used to provide axial restraint. These physical limits may be exceeded with the higher pressures and temperatures associated with deepwater subsea wells.

Sill another method that may be used is to provide a separate lockdown sub dedicated to providing axial restraint for the casing hanger seal and casing hanger. However, the installation of a lockdown sub requires an additional trip of the drill string into and out of the well, a considerable expense. In addition, the lockdown sub occupies space, which is limited in a wellhead. Finally, the lockdown sub does not provide the axial restraint immediately upon installation of the casing hanger and casing hanger seal.

Therefore, an improved technique for preventing axial movement of a casing hanger and casing hanger seal within a wellhead is needed. In particular, a technique is needed to prevent axial movement of a casing hanger or tubing hanger seal within a wellhead immediately upon installation of the casing hanger and casing hanger seal, without interfering with the flow of fluids in the annulus surrounding the casing hanger during cementing operations, without occupying additional space in the wellhead, or requiring additional trips into the well.

BRIEF DESCRIPTION

A wellhead system comprising a seal with a movable restraining member adapted to cooperate with a housing to restrict axial movement of the seal. The seal is adapted to form a seal between the housing, such as a high pressure wellhead, and a tubular member, such as a casing hanger. The restraining member may be a ring that is expanded outward as the seal is installed within the wellhead. The ring may have a split to facilitate the expansion of the ring outward. In addition, the ring may be adapted with a tapered surface that slidingly engages a corresponding tapered surface on the hanger as the seal is installed within the wellhead. The sliding engagement of the tapered surfaces cooperates to urge the restraining member outward. In addition, the corresponding tapered surface may be a shoulder of the tubular member. The seal may have an additional ring with a tapered surface that is adapted to cooperate with a second tapered surface of the restraining member to provide additional mechanical advantage to expand the restraining member outward when the seal is installed in the wellhead.

The restraining member and the housing may be adapted so that a portion of the seal is received by at least one recess in the inner profile of the housing when the restraining member is expanded outward. The portion of the seal that is received in the at least one recess may be one or more projections extending from the ring. The projections may engage the at least one recessed in the housing upon installation. Alternatively, the projections may engage the at least one recess in the housing after axially traveling a distance, enabling the seal to have some axial movement relative to the wellhead.

DRAWINGS

These and other features, aspects, and advantages of the present invention will become better understood when the following detailed description is read with reference to the accompanying drawings in which like characters represent like parts throughout the drawings, wherein.

Figure 14:
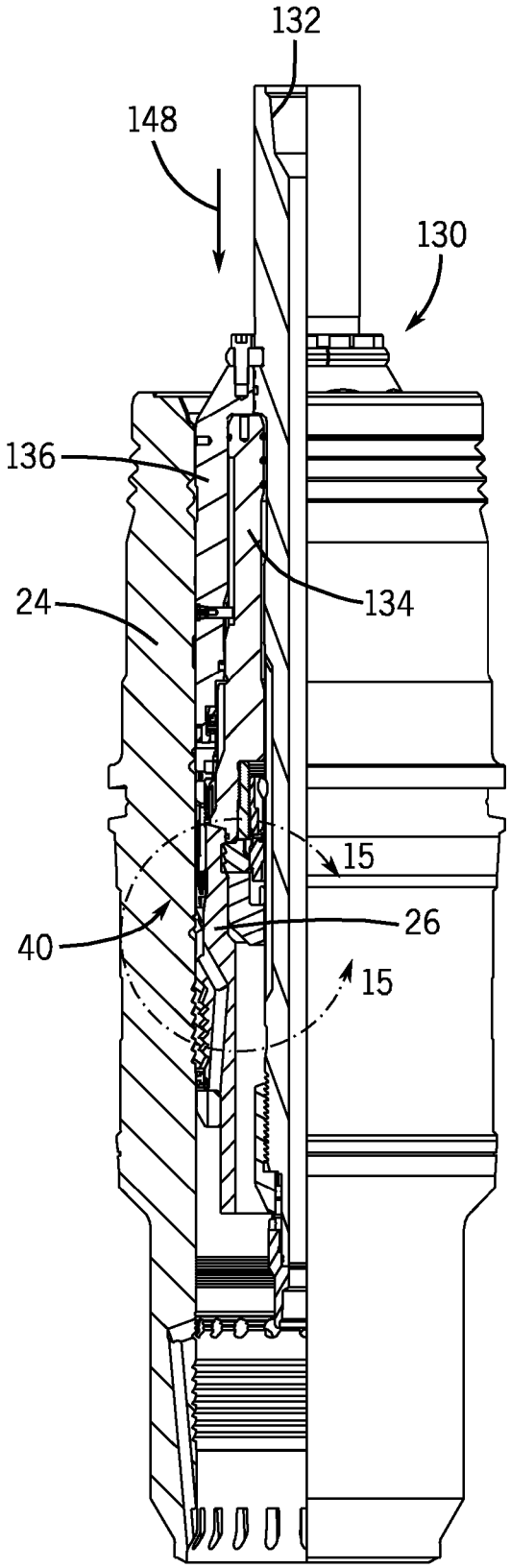
Figure 15:
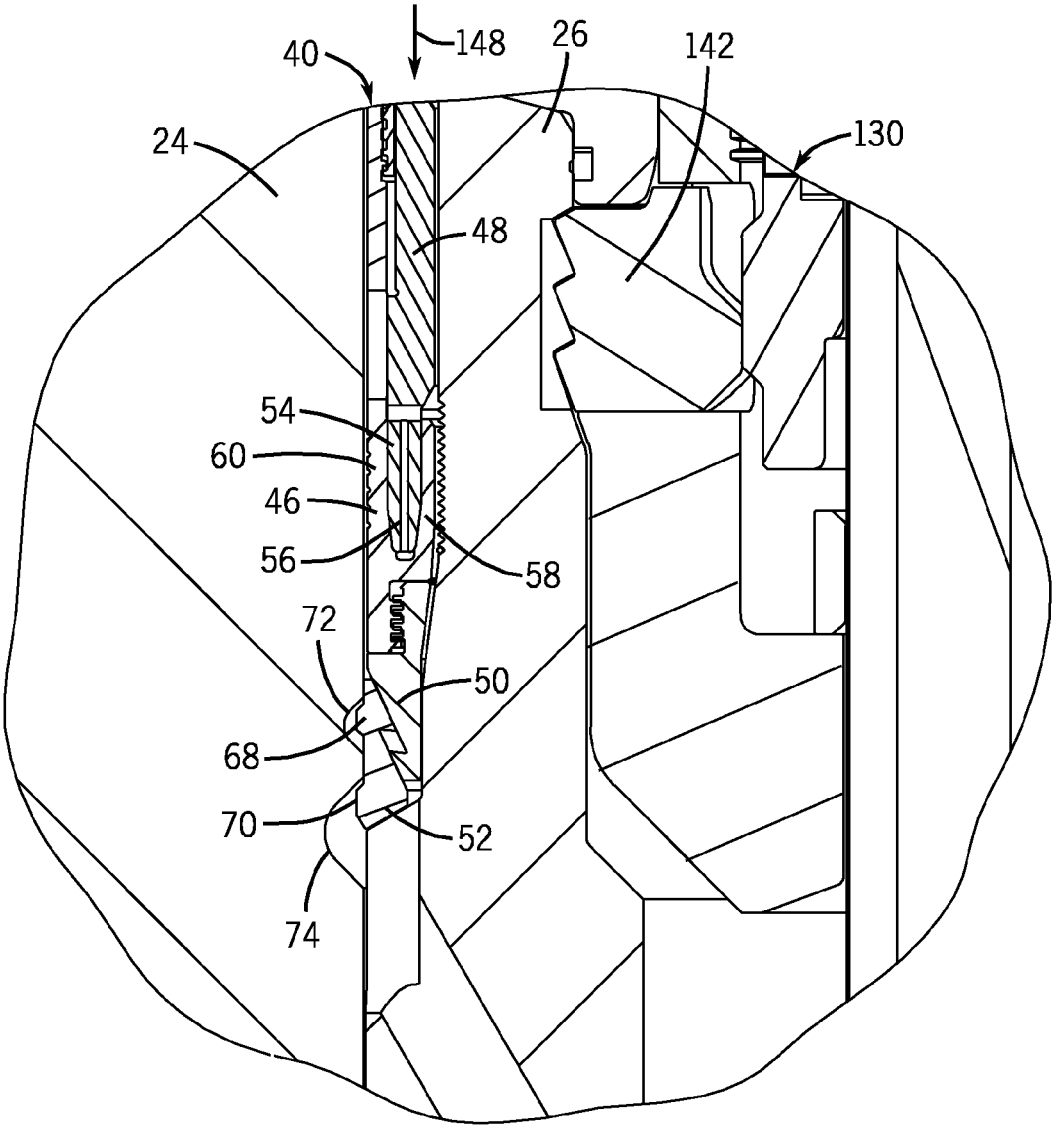

FIG. 14 is a partial cross-sectional view of the high pressure wellhead, first casing hanger, first casing hanger seal, and the setting tool during the casing hanger seal installation with the energizing ring of the casing hanger seal driven into the seal ring of the casing hanger seal to activate the casing hanger seal to seal the annulus between the casing hanger and high pressure wellhead, in accordance with an exemplary embodiment of the present technique; and FIG. 15 is a detailed view of the wellhead, casing hanger, and casing hanger seal of FIG. 14, in accordance with an exemplary embodiment of the present technique.

DETAILED DESCRIPTION

Figure 1:
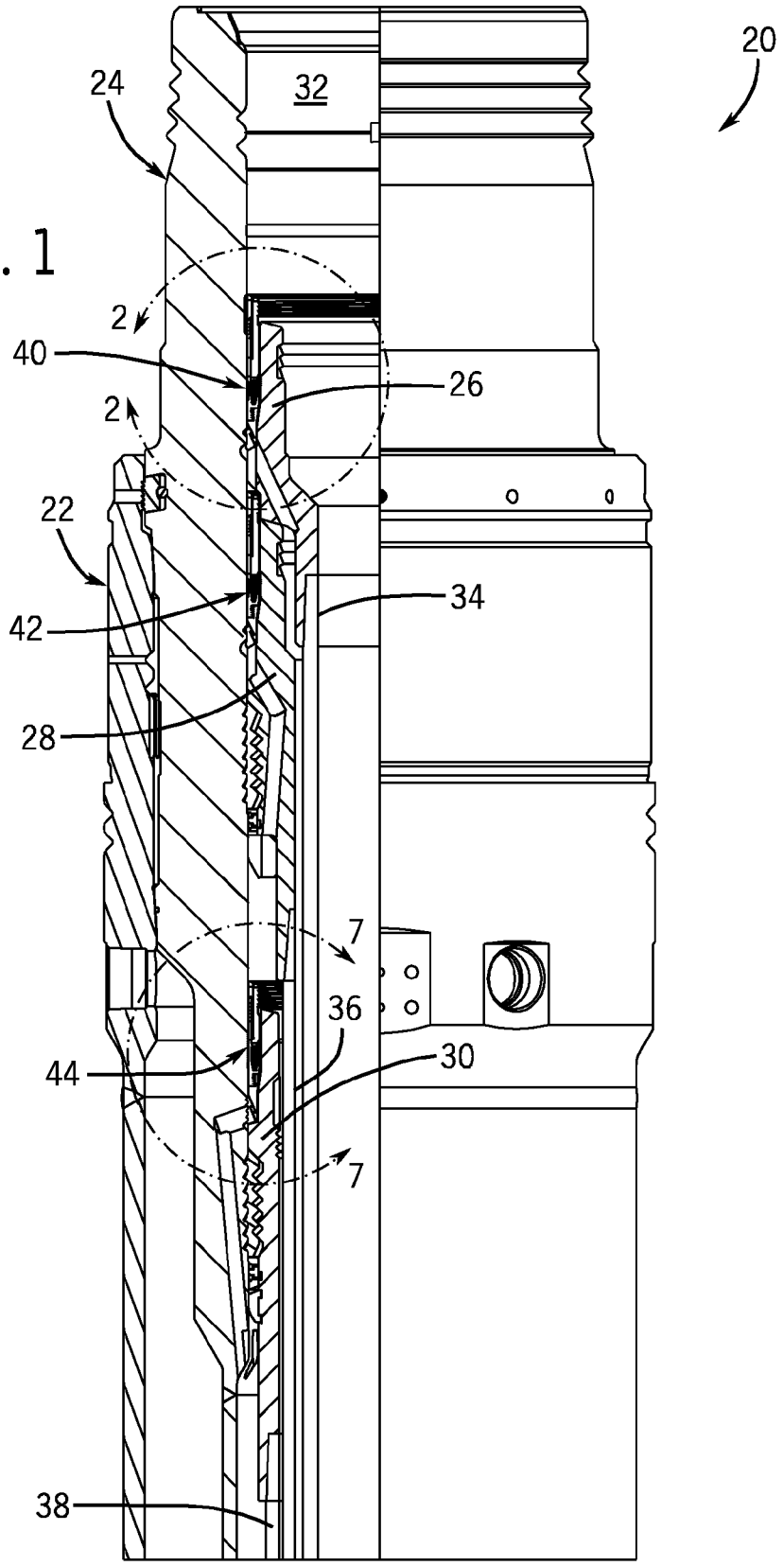
FIG. 1 is a cross-sectional view of a wellhead assembly, in accordance with an exemplary embodiment of the present technique.

Referring now to FIG. 1, the present invention will be described as it might be applied in conjunction with an exemplary technique, in this case a wellhead assembly for directing oil and/or gas from a well to transmission pipelines or a storage facility, as represented generally by reference numeral 20.

The wellhead assembly 20 comprises a low pressure wellhead 22 and a high pressure wellhead 24. In the illustrated embodiment, the high pressure wellhead 24 supports three casing hangers: a first casing hanger 26, a second casing hanger 28, and a third casing hanger 30 within an inner bore 32 of the wellhead 24. However, the high pressure wellhead 24 may be used to support a greater or lesser number of casing hangers. The first casing hanger 26, second casing hanger 28, and third casing hanger 30 support casing strings 34, 36, and 38, respectively.

The annulus between the first casing hanger 26 and the high pressure wellhead 24 is sealed by a first casing hanger seal 40. Similarly, the annulus between the wellhead 24 and the second casing hanger 28 is sealed by a second casing hanger seal 42. Finally, the annulus between the third casing hanger 30 and the high pressure wellhead 24 is sealed by a third casing hanger seal 44. In the illustrated embodiment, the first casing hanger seal 40 and second casing hanger seal 42 are identical. However, the third casing hanger seal 44 differs from the first and second casing hanger seals 40, 42.

As will be discussed in more detail below, the high pressure wellhead 24 and each of the casing hanger seals are adapted to cooperate to restrict axial movement of the casing hanger seals and the casing hangers within the high pressure wellhead 24. In particular, each of the casing hanger seals is adapted with a latch ring that is expanded outward into a corresponding profile in the inner bore 32 of the high pressure wellhead 24. Forces that urge a casing hanger seal upward or downward are opposed by engagement between the latch ring of the casing hanger seal and the high pressure wellhead 24.

Figure 2:
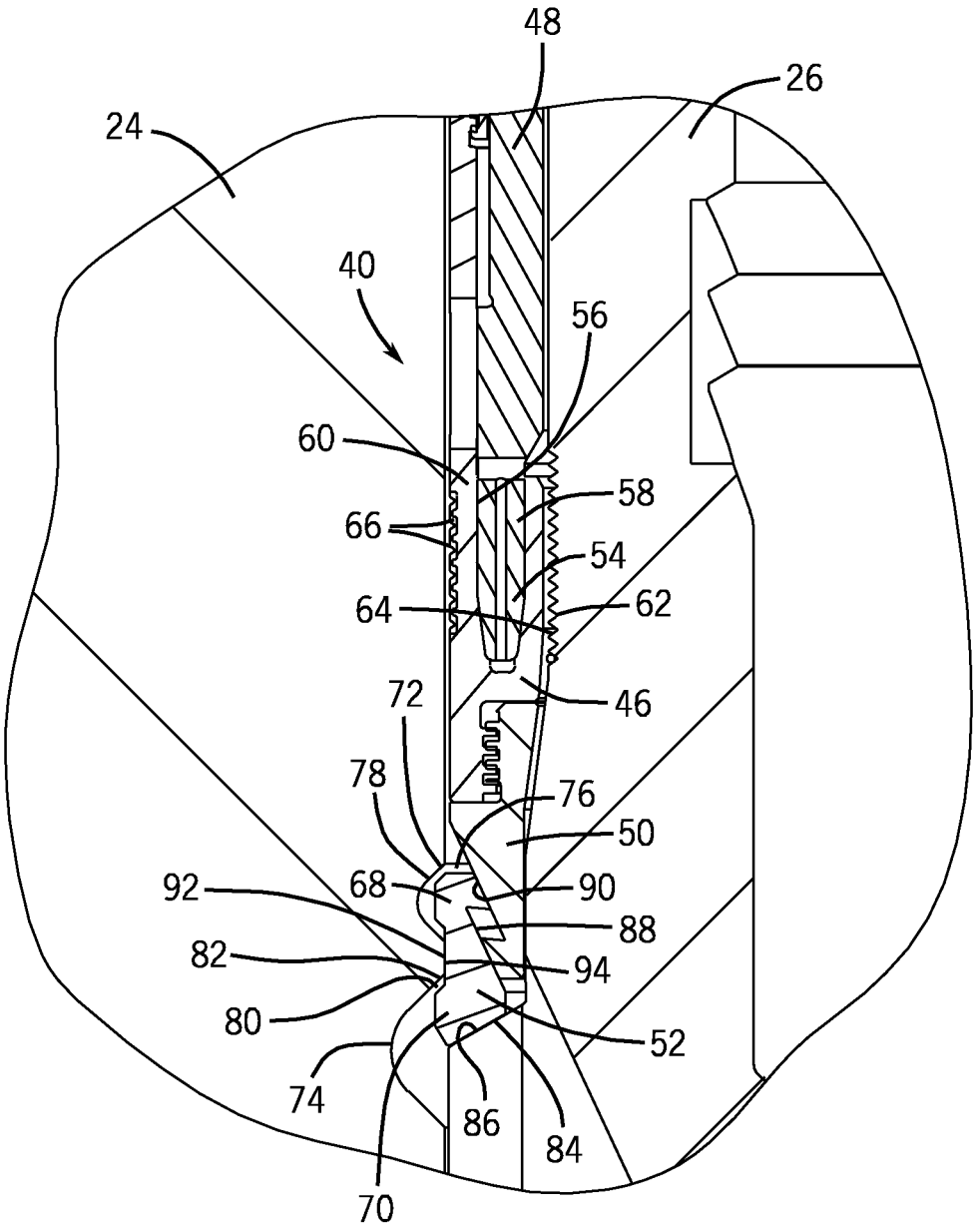
FIG. 2 is a detailed view of a first casing hanger seal of the wellhead assembly of FIG. 1, in accordance with an exemplary embodiment of the present technique.

Referring generally to FIG. 2, the first casing hanger seal 40 comprises a seal ring 46, an energizing ring 48, a nose ring 50, and a latch ring 52. The energizing ring 48 is used to drive the seal ring 46 outward into sealing engagement with the high pressure wellhead 24 and the first casing hanger 26. The energizing ring 48 has a lower portion 54 that is driven into a slot 56 in the seal ring 46 to activate the seal. As the lower portion 54 of the energizing ring 48 is driven into the slot 56 in the seal ring, it elastically deforms an inner leg 58 of the seal ring 46 inward into engagement with the first casing hanger 26 and an outer leg 60 of the seal ring 46 outward into engagement with the wellhead 24.

In the illustrated embodiment, the casing hanger seal 40 has a series of wickers 62 that engage corresponding wickers 64 on the first casing hanger 26 to form a seal between the first casing hanger 26 and the first casing hanger seal 40. In the illustrated embodiment, the material of the first casing hanger seal 40 is softer than the material of the first casing hanger 26 so that the casing hanger seal wickers 62 deform into the wickers 64 of the first casing hanger 26, enhancing the seal between the first casing hanger 26 and the first casing hanger seal 40. In addition, the engagement of the wickers 62, 64 restricts axial movement of the first casing hanger 26 relative to the first casing hanger seal 40. In the illustrated embodiment, the outer leg 60 of the seal ring 46 has inlays 66 that are driven against the wellhead 24 to form a seal between the first casing hanger seal 40 and the wellhead 24. The inlays 66 are adapted to maintain a seal between the first casing hanger seal 40 and the wellhead 24 even if there is some axial movement of the first casing hanger seal 40 relative to the wellhead 24.

As will be discussed in more detail below, the first casing hanger 26 and the first casing hanger seal 40 are installed in the wellhead 24 by a setting tool (not shown). In addition, the setting tool is used to drive the energizing ring 48 downward into the seal ring 46 to activate the first casing hanger seal 40 in the wellhead 24.

The illustrated embodiments of the first casing hanger seal 40 and the wellhead 24 restrict axial movement of the first casing hanger seal 40 to a small amount relative to the wellhead 24. The restriction of the axial movement of the first casing hanger seal 40 relative to the wellhead 24 is achieved by the engagement of the latch ring 52 of the first casing hanger seal 40 with the inner profile of the wellhead 24. As will be discussed in more detail below, the latch ring 52 is split, or may have a notch to allow the latch ring 52 to split during installation. The latch ring 52 of the first casing hanger seal 40 is biased inward to maintain the latch ring 52 as a closed ring during installation. However, as will be discussed in detail below, the latch ring 52 is driven outward into recesses in the wellhead 24 as the first casing hanger seal 40 is installed in the wellhead 24. The latch ring 52 thereby becomes a C-ring.

The axial movement of the first casing hanger seal 40 relative to the wellhead 24 is restricted by engagement between a first projection 68 and a second projection 70 of the seal 40 with a first recess 72 and a second recess 74, respectively, in the profile of the inner bore 32 of the wellhead 24. In the illustrated embodiment, there is a gap 76 between the first projection 68 of the seal 40 and an upper edge 78 of the first recess 72. Similarly, there is a gap 80 between the second projection 70 of the seal 40 and the upper edge 82 of the second recess 74 in the wellhead 24. The gaps 76, 80 between the latch ring 52 and the upper edges 78, 82 of the recesses 72, 74 of the wellhead allow some upper axial movement of the seal 40 relative to the wellhead 24. However, upward axial movement of the first casing hanger seal 40 is limited by engagement between the first projection 68 of the seal 40 and the upper edge 78 of the first recess 72 of the wellhead 24. In addition, upward axial movement of the seal 40 is restricted by engagement between the second projection 70 of the seal 40 and the upper edge 82 of the second recess 74 of the wellhead 24. Similar gaps are present below the projections 68, 70. Downward axial movement of the seal 40 is limited by engagement between the projections 68, 70 of the seal 40 and the lower edges of the recesses 72, 74 of the wellhead 24.

The first projection 68 and second projection 70 of the latch ring 52 are driven into the first recess 72 and second recess 74 of the wellhead 24 during the installation of the first casing hanger seal 40 into the wellhead 24. As the latch ring 52 of the first casing hanger seal 40 is lowered into the wellhead 24, a downward-facing tapered surface 84 of the seal 40 engages an upward-facing tapered shoulder 86 of the first casing hanger 26. The engagement between the downward-facing tapered surface 84 of the latch ring 52 of the seal 40 and the upward-facing tapered shoulder 86 of the first casing hanger 26 as the seal 40 is lowered further into the wellhead 24 drives the latch ring 52 outward. In addition, the latch ring 52 has an inward-facing tapered surface 88 that engages an outward-facing tapered surface 90 of the nose ring 50. The engagement of the inward-facing tapered surface 88 of the latch ring 52 with the outward-facing tapered surface 90 of the nose ring 50 provides additional mechanical advantage to overcome the inward bias of the latch ring 52 and drive the latch ring 52 outward. The outward movement of the latch ring 52 is limited by engagement between a stop portion 92 of the latch ring 52 and a corresponding stop portion 94 of the wellhead 24. The engagement of the stop portion 92 of the latch ring 52 with the stop portion 94 of the wellhead 24 position the projections 68, 70 of the latch ring 52 at a desired position within the recessed profiles 72, 74 of the wellhead 24.

The latch ring 52 of the first casing hanger seal 40 is removed with the seal 40 when the seal is removed from the wellhead 24. The energizing ring 48 of the seal 40 is withdrawn from the seal ring 46 of the seal 40 to enable the inner leg 58 and the outer leg 60 of the seal ring 46 to relax and withdraw to their original shape, disengaging the seal ring 46 from the first casing hanger 26 and the wellhead 24, respectively. The latch ring 52 has a first catch surface 96 that extends over a corresponding second catch surface 98 of the nose ring 50. During removal of the first casing hanger seal 40, the second catch surface 98 of the nose ring 50 engages the first catch surface 96 of the latch ring 52, lifting the latch ring 52 upward. Thus, the axial restraint for the first casing hanger seal 40 is removed on the same trip as the first casing hanger seal 40 is removed. Therefore, removal of the axial restraining member of the casing hanger and/or seal does not require an additional trip into the well to remove. In addition, the cooperation of the first catch surface 96 and second catch surface 98 secures the latch ring 52 to the nose ring 50.

Figure 3:
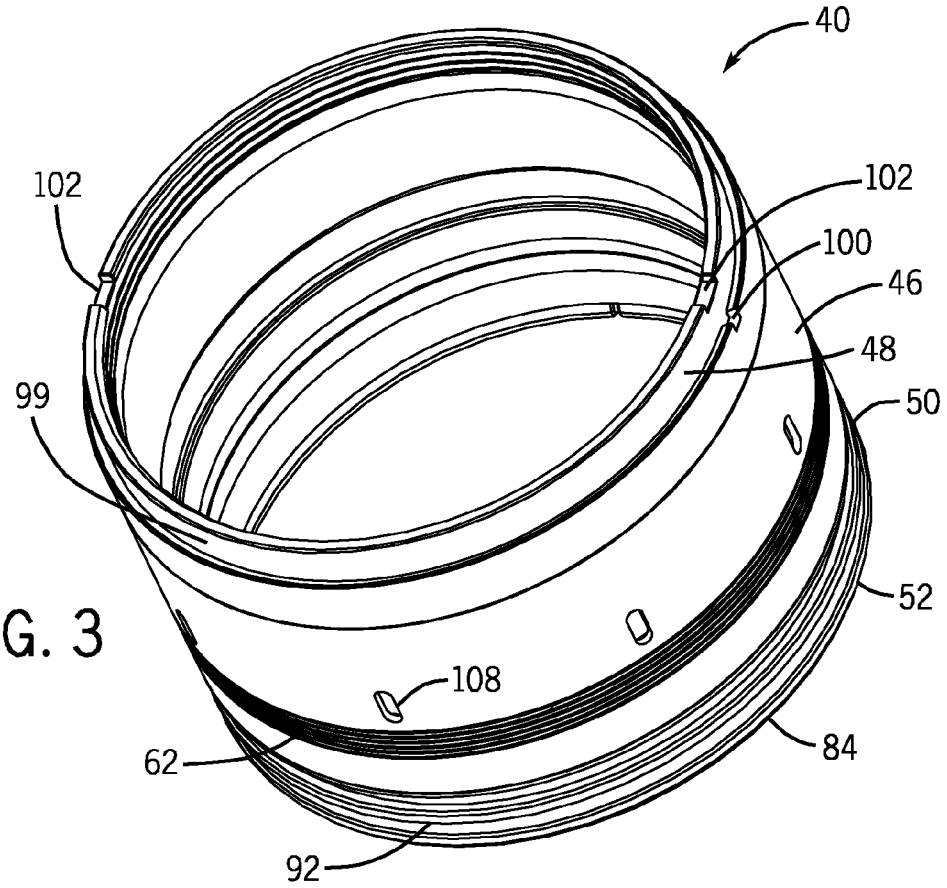
FIG. 3 is a perspective view of the first casing hanger seal, in accordance with an exemplary embodiment of the present technique.
Figure 4:
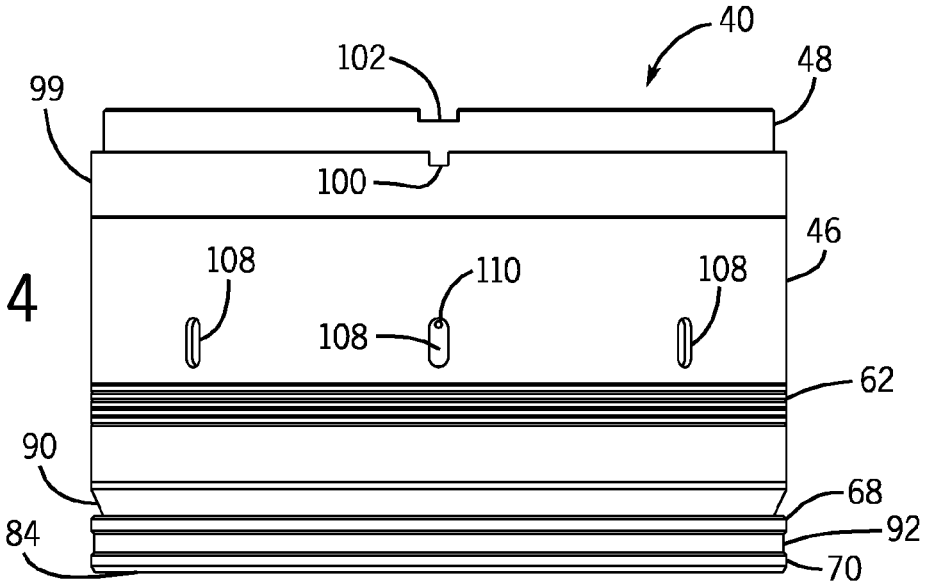
FIG. 4 is an elevation view of the first casing hanger seal of FIG. 3, in accordance with an exemplary embodiment of the present technique.
Figure 5:
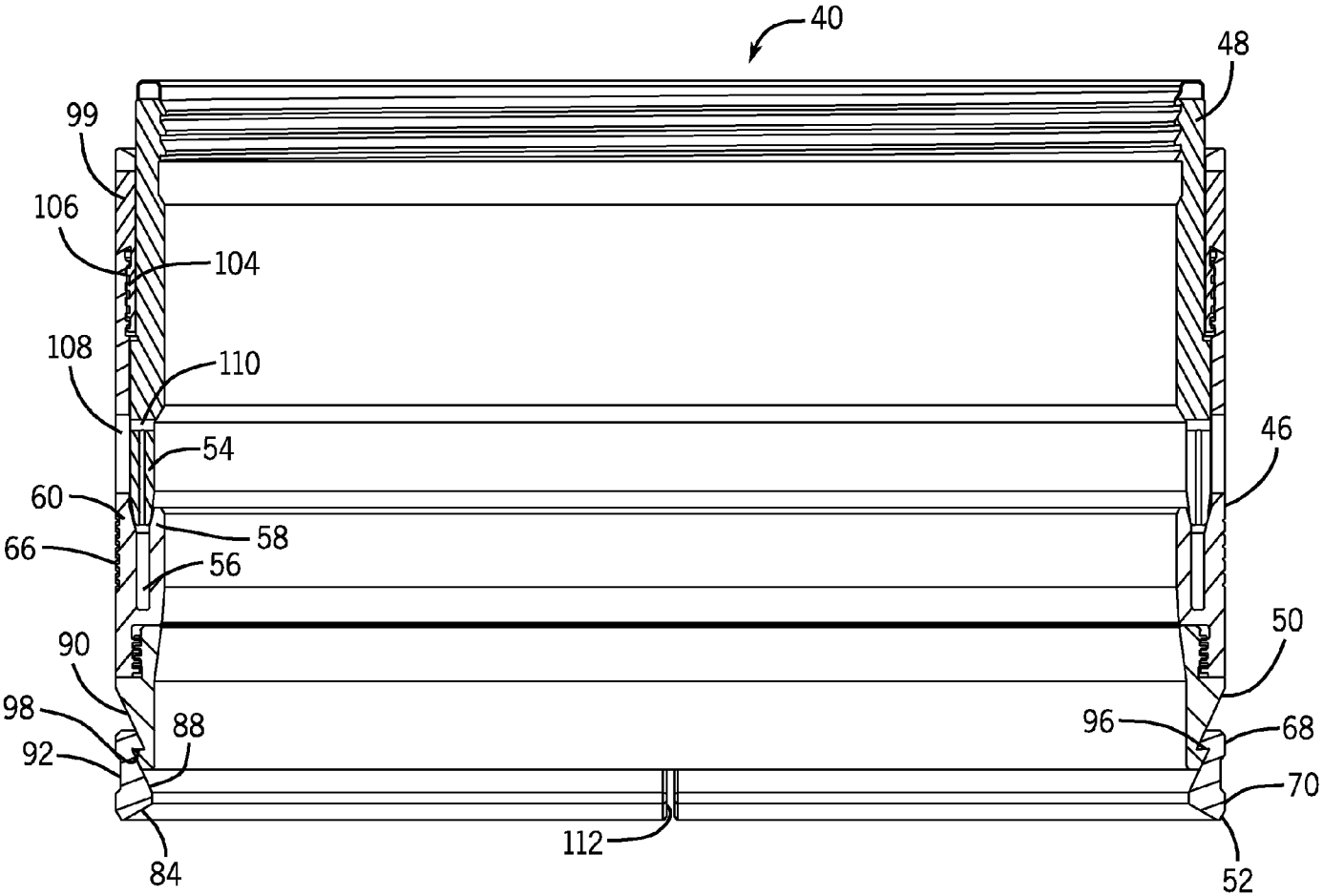
FIG. 5 is a cross-sectional view of the first casing hanger seal assembly of FIG. 4, in accordance with an exemplary embodiment of the present technique.

Referring generally to FIGS. 3-5, various views of the first casing hanger seal 40 are presented. As discussed above, the seal ring 46 is activated by driving the energizing ring 48 into the seal ring 46. An upper ring 99 is threaded to the seal ring 46. The upper ring 99 has a first pair of notches 100 and the energizing ring 48 has a second pair of notches 102 that are used by the setting tool to engage the energizing ring 48 and the seal ring 46. As best illustrated in FIG. 5, the upper ring 99 and the seal ring 46 have threaded portions 104, 106, respectively.

As best seen in FIGS. 4 and 5, the seal ring 46 has a port 108 and the energizing ring 48 has a channel 110 that enable pressure to equalize within the seal 40, preventing hydraulic lock when the energizing ring 48 is driven into the seal ring 46. Prior to installation, the slot 56 in the seal ring 46 may be filled with grease. The port 108 and channel 110 enable the grease, and any other fluids, within the slot 56 to equalize between the inside of the seal 40 and the outside of the seal 40 as the lower portion 54 of the energizing ring 48 is driven into the slot 56 of the seal ring 46. As a result, there is no build-up of pressure in the slot 56 or the outside of the seal 40.

Figure 6:
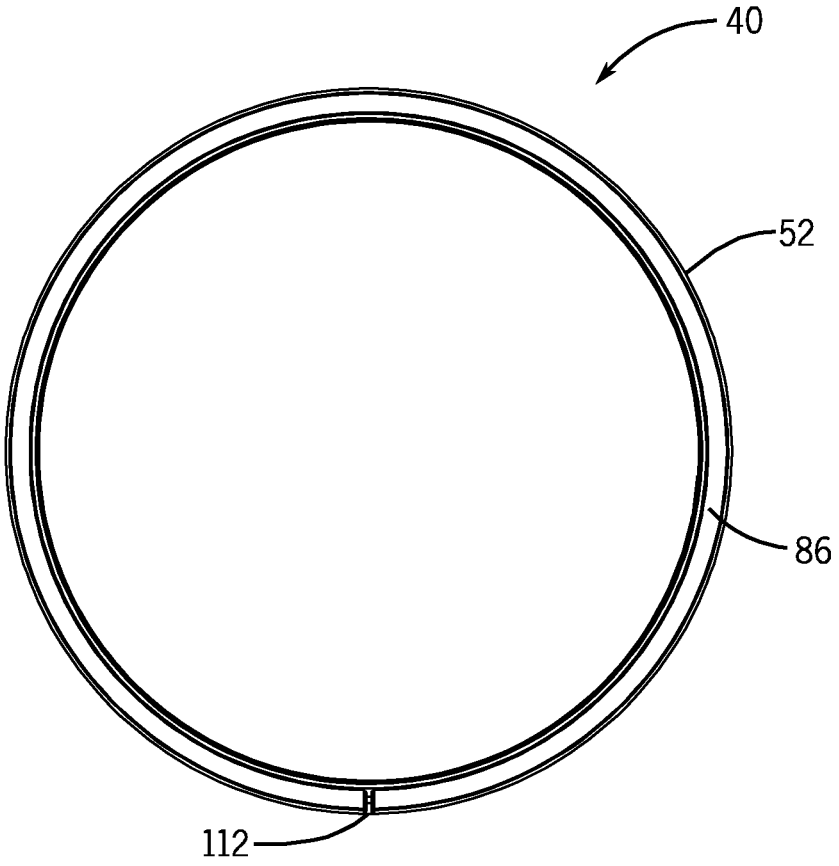
FIG. 6 is a bottom view of the latch ring of the first casing hanger seal assembly of FIG. 4, in accordance with an exemplary embodiment of the present technique.

Referring generally to FIGS. 5 and 6, the illustrated embodiment of the latch ring 52 has a split 112 that enables the latch ring 52 to expand as it is driven outward during installation. Alternatively, the latch ring 52 may be notched so that there is a weakened region in the latch ring 52 that splits as the latch ring 52 is urged outward upon engagement with the shoulder of the casing hanger.

Figure 7:
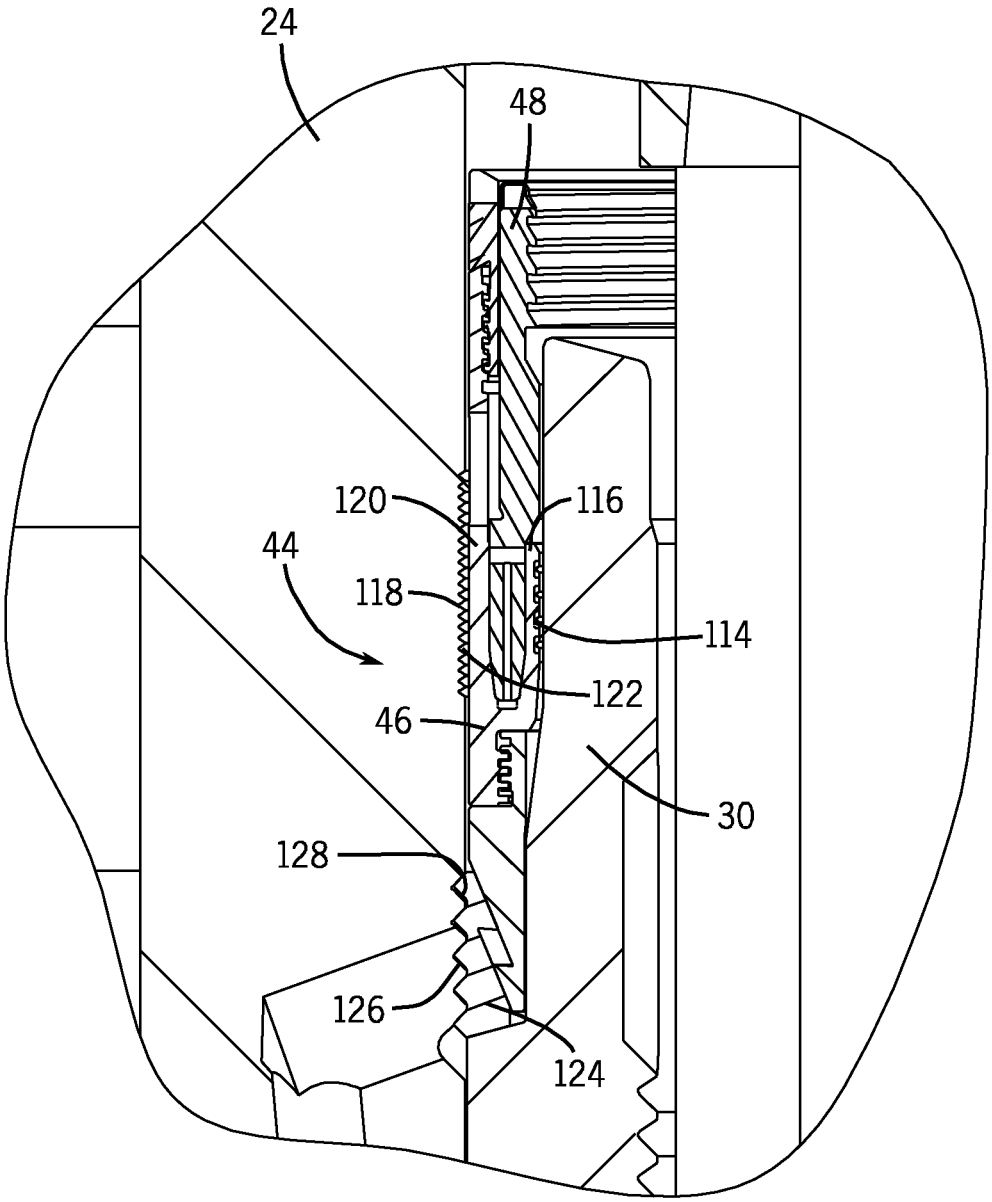
FIG. 7 is a detailed view of an additional casing hanger seal of the wellhead assembly of FIG. 1, in accordance with an exemplary embodiment of the present technique.

Referring generally to FIG. 7, the third casing hanger 30 and third casing hanger seal 44 are presented. In contrast to the first casing hanger seal 40, the third casing hanger seal 44 has inlays 114 on its inner leg 116 and wickers 118 on its outer leg 120. Corresponding wickers 122 on the wellhead 24 are provided to engage the wickers 118 on the third casing hanger seal 44. The inlays 114 enable relative movement between the third casing hanger 30 and the third casing hanger seal 44. The engagement of the wickers 118, 122 forms a seal between the third casing hanger seal 44 and the wellhead 24, as well as restricting axial movement of the third casing hanger seal 44 relative to the wellhead 24.

In the illustrated embodiment, the third casing hanger seal 44 has an alternative embodiment of a latch ring 124. The latch ring 124 has a series of teeth 126 that are driven into a corresponding toothed profile 128 in the inner bore 32 of the wellhead 24. Here, the teeth 126 are driven into engagement with the toothed profile 128 in the wellhead 24, preloading the latch ring 124 with the wellhead 24. Any upward or downward force on the third casing hanger seal 44 is opposed by engagement between the latch ring 124 and the wellhead 24. Installation and removal of the third casing hanger 30 and third casing hanger seal 44 is the same as for the first casing hanger 26 and first casing hanger seal 40.

Referring generally to FIGS. 8-15, the process of installing a casing hanger and casing hanger seal is presented. The casing hanger and casing hanger seal are installed within the wellhead 24 as a pair by a setting tool 130. The setting tool 130 has a connector 132 for connecting the setting tool 130 to a drill string. In addition, the setting tool 130 has a casing hanger handling member 134 that is used to install the casing hanger and a casing hanger seal handling member 136 that is used to install the casing hanger seal. The casing hanger handling member 134 and casing hanger seal handling member 136 are configured to enable relative movement between them.

Figure 8:
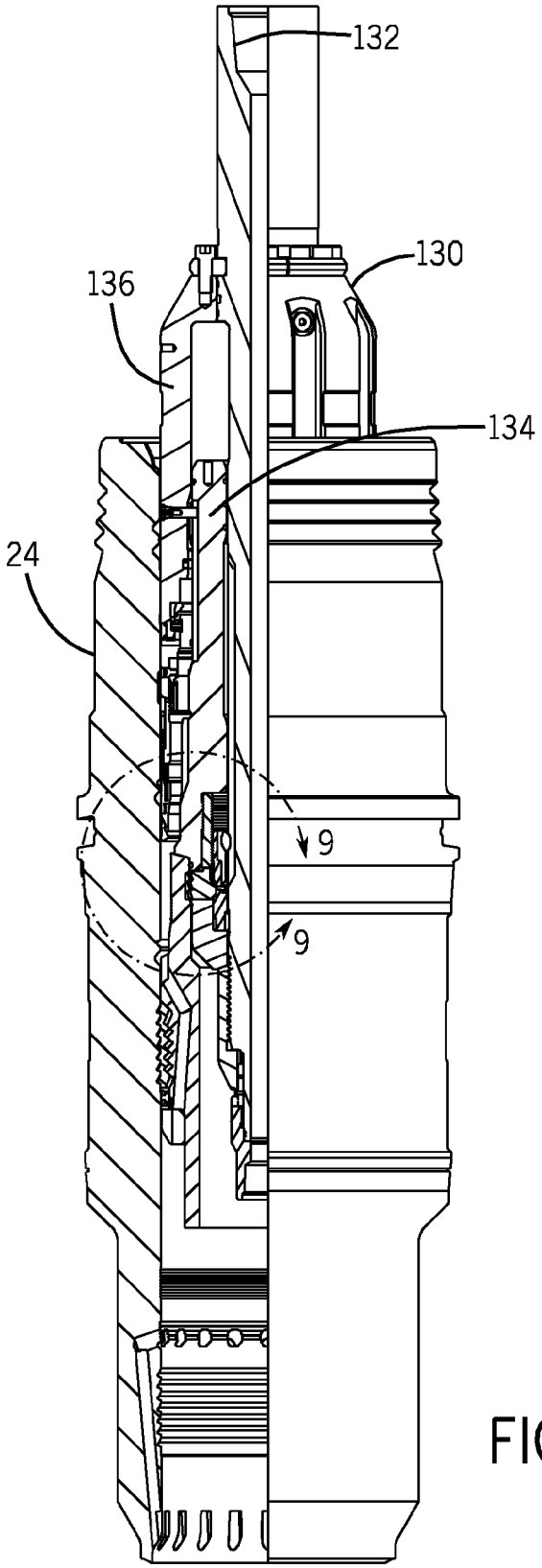
FIG. 8 is a partial cross-sectional view of the high pressure wellhead, first casing hanger, first casing hanger seal, and a setting tool for installing the casing hanger and casing hanger seal during the running of the casing hanger and casing hanger seal into the well, in accordance with an exemplary embodiment of the present technique.
Figure 9:
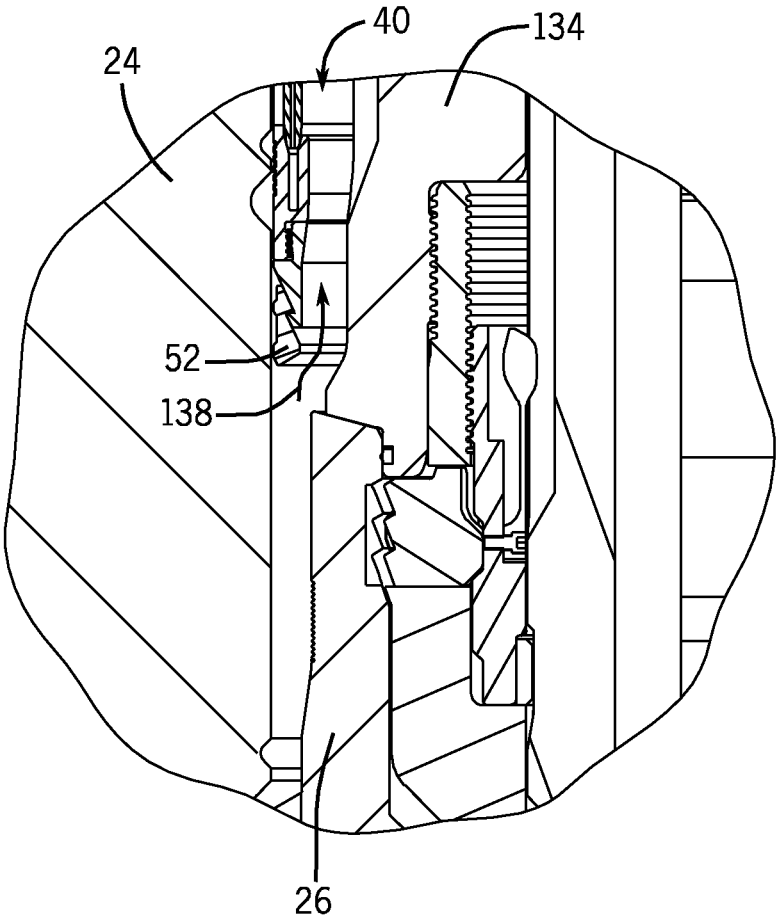
FIG. 9 is a detailed view of the wellhead, casing hanger, and casing hanger seal of FIG. 8, in accordance with an exemplary embodiment of the present technique.

Referring generally to FIGS. 8 and 9, the setting tool 130 positions the first casing hanger seal 40 above the first casing hanger 26 as the two are lowered into the wellhead 24. The first casing hanger 26 may be landed on a shoulder of the wellhead 24 or another casing hanger. Once the first casing hanger 26 is in a desired position within the wellhead 24, the first casing string 34 is cemented into place. Cement is pumped down through the center of the first casing string 34 and flows upward in the annulus between the first casing string 34 and an adjacent outer casing string (not shown).

As best illustrated in FIG. 9, there is a free flow path 138 for cement and other well fluids to flow upward from below the first casing hanger 26 through the annulus between the first casing hanger seal 40 and the first casing hanger 26 during the cementing operations because the axial restraint for the first casing hanger 26 and first casing hanger seal 40 is provided on the first casing hanger seal 40, rather than on the first casing hanger 26. If the axial restraint was provided by a restraining member disposed between the first casing hanger 26 and the wellhead 24, the restraining member would interfere with the flow of fluids flowing up the wellbore from below the first casing hanger 26.

Figure 10:
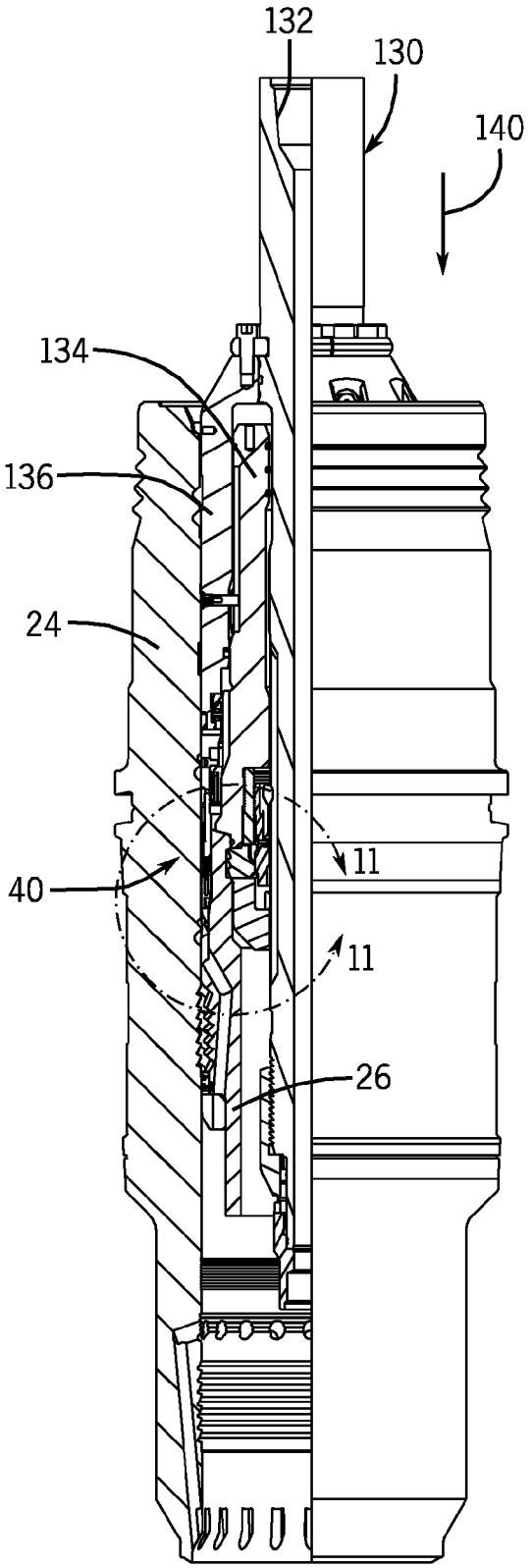
FIG. 10 is a partial cross-sectional view of the high pressure wellhead, first casing hanger, first casing hanger seal, and the setting tool during the casing hanger seal installation with the latch ring of the casing hanger seal landed on a shoulder of the casing hanger, in accordance with an exemplary embodiment of the present technique.
Figure 11:
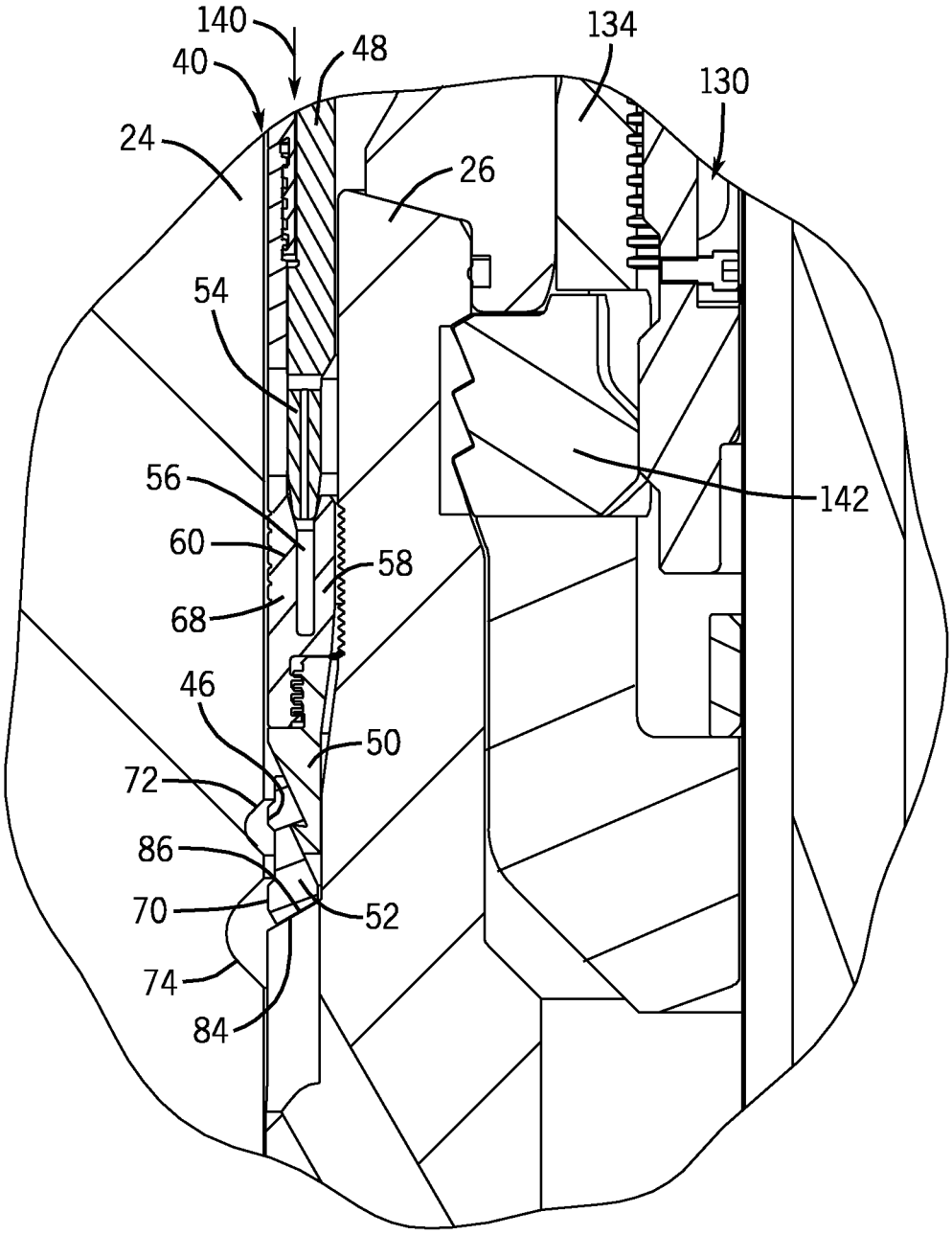
FIG. 11 is a detailed view of the wellhead, casing hanger, and casing hanger seal of FIG. 10, in accordance with an exemplary embodiment of the present technique.

Referring generally to FIGS. 10 and 11, the drill string is used to lower the setting tool 130 still further into the wellhead 24, as represented generally by arrow 140, to install the first casing hanger seal 40 in the desired position within the wellhead 24. The casing hanger handling member 134, which is secured to the first casing hanger 26, remains stationary while the casing hanger seal handling member 136 of the setting tool 130 is lowered with the first casing hanger seal 40.

In the view presented in FIG. 11, the downward-facing tapered surface 84 of the latch ring 52 has just contacted the shoulder 86 of the first casing hanger 26 during the process of installing the first casing hanger seal 40. The latch ring 52 has not yet been driven outward at this point of the casing hanger seal installation process. In addition, this view enables the releasable dogs 142 of the setting tool 130 to be seen. The releasable dogs 142 are used to secure the casing hanger handling member 134 to the first casing hanger 26, as well as the second and third casing hangers 28, 30.

Figure 12:
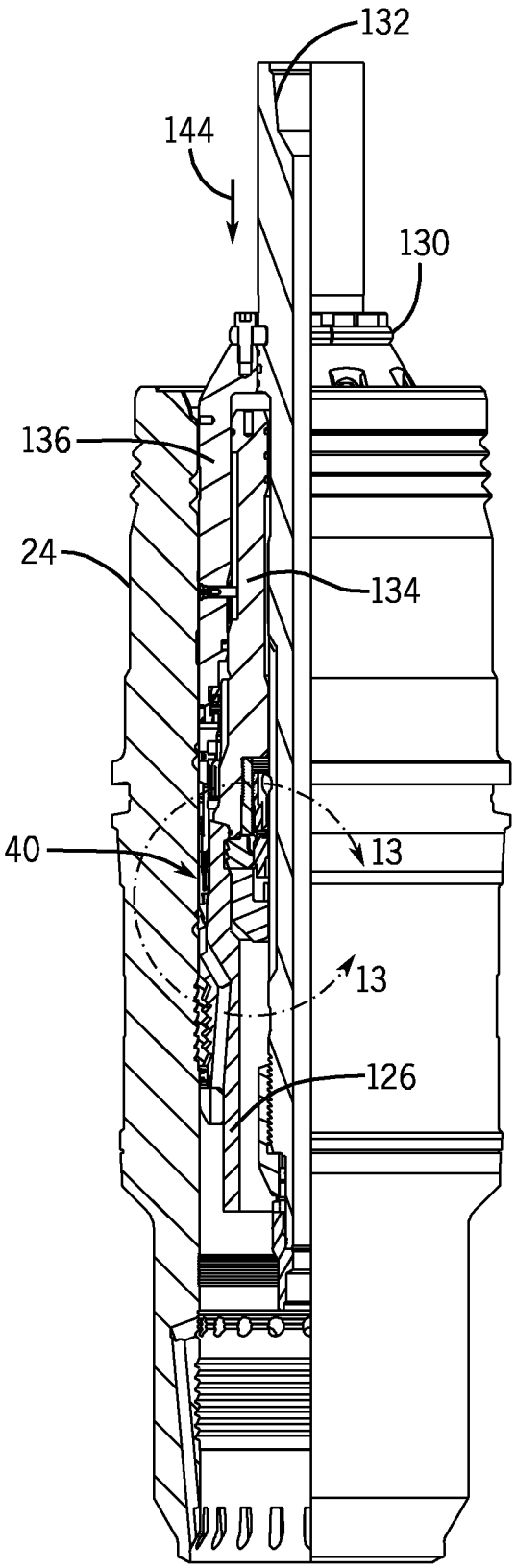
FIG. 12 is a partial cross-sectional view of the high pressure wellhead, first casing hanger, first casing hanger seal, and the setting tool during the casing hanger seal installation with the latch ring of the casing hanger seal driven outward into the wellhead, in accordance with an exemplary embodiment of the present technique.
Figure 13:
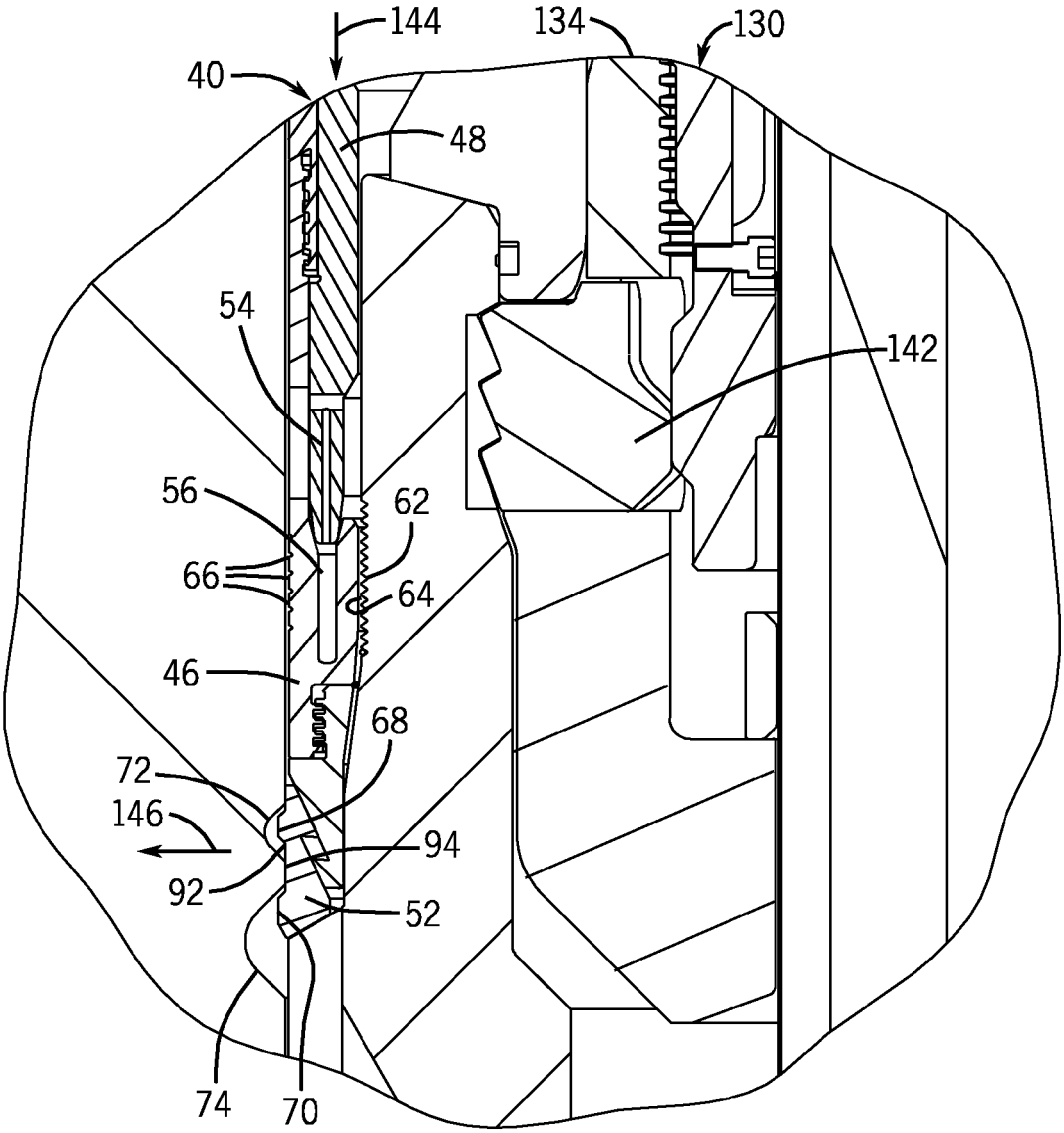
FIG. 13 is a detailed view of the wellhead, casing hanger, and casing hanger seal of FIG. 12, in accordance with an exemplary embodiment of the present technique.

Referring generally to FIGS. 12 and 13, the continued downward movement of the drill string lowers the casing hanger seal handling member 136 of the setting tool 130 further into the wellhead 24, as represented generally by arrow 144. This downward movement drives the latch ring 52 of the first casing hanger seal 40 outward, as represented by arrow 146, into the recessed profiles 72, 74 of the wellhead 24. As noted above, the stop portion 92 of the latch ring 52 abuts the stop portion 94 of the wellhead 24 to end the outward movement of the latch ring 52. This positions the projecting members 68, 70 of the latch ring 52 at the desired depth within the recessed portions 72, 74 of the wellhead 24.

Referring generally to FIGS. 14 and 15, the setting tool 130 is then used to drive the energizing ring 48 downward relative to the seal ring 46 to activate the seal ring 46, as represented by arrow 148, forming a seal between the first casing hanger 26 and the wellhead 24. The lower portion 54 of the energizing ring 48 is driven into the slot 56 of the seal ring 46. The inner leg 58 of the seal ring 46 is driven against the first casing hanger 26 and the outer leg 60 is driven against the wellhead 24, sealing the annulus between the first casing hanger 26 and the wellhead 24.

The process is reversed to remove the first casing hanger 26 and the first casing hanger seal 40. The setting tool 10 or another tool is used to apply a force to withdraw the energizing ring 48 from the seal ring 46. The first casing hanger seal 40 is then lifted. The latch ring 52 is lifted with the other portions of the first casing hanger seal 40 as the seal 40 is lifted from the wellhead 24. In addition, the latch ring 52 is withdrawn from the recessed profiles 72, 74 as the latch ring 52 is lifted.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A wellhead assembly, comprising:

a housing, comprising an inner bore and an inner profile disposed around a portion of the inner bore of the housing; and a seal assembly adapted to form a seal between a tubular member and the housing, the seal assembly, comprising:

a seal member;

an energizing ring adapted to be driven into the seal member to expand the seal member into sealing engagement with an inner surface of the housing and an outer surface of the tubular member;

a latch ring secured to and carried by the seal member and axially movable relative to the seal member and the tubular member, wherein the latch ring is adapted to be driven outward into the inner profile of the housing, whereupon axial movement of the seal assembly is restricted by abutment between the latch ring and the inner profile of the housing; and wherein the tubular member comprises a tapered shoulder and the latch ring comprises a first tapered surface, the tapered shoulder of the tubular member and the first tapered surface of the latch ring being adapted to cooperate to drive the latch ring outward when the seal assembly and the tubular member abut.

2. The wellhead assembly as recited in claim 1, wherein the latch ring is a split ring.

3. The wellhead assembly as recited in claim 1, wherein the seal assembly comprises a nose ring having a tapered surface and the latch ring comprises a second tapered surface, the tapered surface of the nose ring and the second tapered surface of the latch ring being adapted to cooperate to drive the latch ring outward when the seal assembly is abutted against the tubular member.

4. The wellhead assembly as recited in claim 3, wherein the latch ring comprises a first catch surface and the nose ring comprises a second catch surface, the first catch surface and second catch surface being adapted to cooperate to lift the latch ring when the nose ring is lifted from the housing during removal of the seal assembly.

5. The wellhead assembly as recited in claim 1, wherein the tapered shoulder comprises an upward-facing tapered surface.

6. The wellhead assembly as recited in claim 5, wherein the first tapered surface of the latch ring comprises a downward-facing tapered surface.

7. The wellhead assembly as recited in claim 1, wherein the seal assembly comprises a first series of wickers and the tubular member comprises a second series of wickers, the first series of wickers being urged against the second series of wickers when the seal member engages the tubular member.

8. A wellhead assembly, comprising:

a housing, comprising an inner bore and an inner profile disposed around a portion of the inner bore of the housing;

a seal assembly adapted to form a seal between a tubular member and the housing, the seal assembly comprising:

a seal member;

an energizing ring adapted to be driven into the seal member to expand the seal member into sealing engagement with an inner surface of the housing and an outer surface of the tubular member; and a latch ring secured to the seal member and axially movable relative to the seal member, wherein the latch ring is adapted to be driven outward into the inner profile of the housing, whereupon axial movement of the seal assembly is restricted by abutment between the latch ring and the inner profile of the housing;

wherein the tubular member comprises a tapered shoulder and the latch ring comprises a first tapered surface, the tapered shoulder of the tubular member and the first tapered surface of the latch ring being adapted to cooperate to drive the latch ring outward when the seal assembly and the tubular member abut;

wherein the seal assembly comprises a nose ring having a tapered surface and the latch ring comprises a second tapered surface, the tapered surface of the nose ring and the second tapered surface of the latch ring being adapted to cooperate to drive the latch ring outward when the seal assembly is abutted against the tubular member; and wherein the latch ring comprises a first catch surface and the nose ring comprises a second catch surface, the first catch surface and second catch surface being adapted to cooperate to lift the latch ring when the nose ring is lifted from the housing during removal of the seal assembly.

* * * * *